US006743989B2

(12) United States Patent
Strümpler

(10) Patent No.: US 6,743,989 B2
(45) Date of Patent: Jun. 1, 2004

(54) MICROSWITCH

(75) Inventor: Ralf Strümpler, Gebenstorf (CH)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 10/344,278

(22) PCT Filed: Aug. 20, 2001

(86) PCT No.: PCT/CH01/00508

§ 371 (c)(1),
(2), (4) Date: May 7, 2003

(87) PCT Pub. No.: WO02/17342

PCT Pub. Date: Feb. 28, 2002

(65) Prior Publication Data

US 2003/0169136 A1 Sep. 11, 2003

(30) Foreign Application Priority Data

Aug. 21, 2000 (DE) ..... 100 40 867

(51) Int. Cl.[7] ..... H01H 57/00
(52) U.S. Cl. ..... 200/181; 257/415
(58) Field of Search ..... 200/181; 257/415

(56) References Cited

U.S. PATENT DOCUMENTS 5,638,946 A 6/1997 Zavracky
5,677,823 A 10/1997 Smith
5,847,631 A 12/1998 Taylor et al.
6,023,121 A 2/2000 Dhuler et al.
6,057,520 A 5/2000 Goodwin-Johansson

FOREIGN PATENT DOCUMENTS

DE 3833158 A1 4/1990
DE 19912669 A1 9/2000
EP 1014412 A2 6/2000
EP 1026718 A2 8/2000
JP 10162713 A 6/1998

*Primary Examiner*—Ramon M Barrera
(74) *Attorney, Agent, or Firm*—Burns, Doane, Swecker & Mathis, L.L.P.

(57) ABSTRACT

A microswitch produced from a predominantly plate-shaped substrate can include: a stationary contact piece (7, 9) on the substrate, a moveable contact piece (6), which electrical contacts the stationary contact piece (7, 9) in the switch-on position of the switch and is electrically isolated from the stationary contact piece in the switch-off position of the switch, a bendable contact carrier (1) which holds the moveable contact piece (6) and is fixed to the substrate by two ends (2, 3), and a drive (10) which guides the contact carrier (1) into the switch-on or switch-off position by elastic deformation. The contact carrier (1) can deform in substrate-parallel fashion. In a stable position corresponding to the switch-off position, the contact carrier (1) has the form of a symmetrical antinode. In a stable position corresponding to the switch-on position, the contact carrier (1) is deformed in the manner of an asymmetrical antinode.

10 Claims, 2 Drawing Sheets

MICROSWITCH

TECHNICAL FIELD

The invention is based on a microswitch according to the preamble of patent claim 1. Such a switch is fitted on a substrate and has a contact arrangement provided for switching a current on or off and an electrically actuable drive for a moveable contact piece of the contact arrangement. By means of the drive, which may operate for example electrostatically, electro-magnetically, piezoelectrically or thermally, the moveable contact piece is moved from a switch-off position to a switch-on position, or vice versa, a contact carrier which can be elastically deformed by bending providing for a restoring force.

The microswitch can be produced by known methods of semiconductor technology or comparable methods of micromachining and is therefore particularly suitable for integration with other semiconductor-technological devices, in particular integrated circuits.

In addition, the microswitch has extremely fast response times in comparison with conventional electromagnetic switches on account of the small moving masses. At the same time, the required switching powers are very low, so that considerable power savings can be achieved in particular in the case of multiple use in a relatively large circuit.

PRIOR ART

With the preamble of patent claim 1, the invention refers to a prior art of microswitches as is specified for example in U.S. Pat. No. 5,638,946A. A microswitch described in FIG. 4 of this document contains a substrate of plate-type design, the two electrically conductive end parts 96*a*, 96*b* of a flexible contact carrier which is bent in a U-shaped manner being fixed on the surface of said substrate. A bridge contact piece 99 is fitted on the contact carrier in an electrically insulated manner. Furthermore, two stationary contact pieces 94 and 94' and two control electrodes 92*a* and 92*b* are arranged on the substrate surface. During the operation of this switch, an electric field is applied to the control electrode 92*a* and the end part 96*a* or to the control electrode 92*b* and the end part 96*b*, which electric field bends the contact carrier in the direction of the substrate surface. The bridge contact 99 then short-circuits the two contact pieces 94, 94' and current can then flow from the contact piece 94 via the bridge contact 99 to the contact piece 94'. The electric field holds the bridge contact in the switch-on position counter to the spring force of the contact carrier. In order to open the switch, the electric field is reduced by changing the voltage of the control electrode 92*a* or 92*b* and the bending of the contact carrier is reversed with the contacts being isolated. The force applied by the drive is comparatively low. Moreover, the switch opens in an undesirable manner in the event of an unintentional weakening or in the event of failure of the electric field.

SUMMARY OF THE INVENTION

The invention, as it is defined in the patent claims, achieves the object of specifying a microswitch of the type mentioned in the introduction which can be operated with a low expenditure of force and energy and which at the same time is distinguished by high operational reliability.

In the case of the microswitch according to the invention, the flexible contact carrier fixed at both ends is designed such that it can be deformed parallel to the plate-type substrate and has two stable positions which can be reached by elastic deformation of the contact carrier, of which positions one is assigned to the switch-off position and the other to the switch-on position. A switch drive which effects the transition from the switch-off position to the switch-on position and vice versa from the switch-on position to the switch-off position therefore only has to apply a comparatively low deformation energy during a switching operation. Since reliable contact-making or reliable contact isolation is ensured by the two stable positions, a high operational reliability of the switch is ensured even without additional securing means or without an additional force, as is brought about for instance by an electric field. This advantageously makes use of the fact that one of the two stable positions is achieved by shaping a contact carrier designed as a symmetrical antinode as early as during the production of the switch, for example by deep reactive ion etching (DRIE). At the same time, it has been recognized that the other of the two stable positions can be achieved if the symmetrical antinode is converted into an asymmetrical antinode by elastic deformation. Since the contact carrier executes a relatively large swing during the transition from one stable position to the other, an isolating path which is formed in the event of switch-off and is defined by the swing, between the opened contacts of the switch, is distinguished by high dielectric strength.

An asymmetrical antinode can be achieved if the stationary contact piece, at the point at which it touches the moveable contact piece, has a smaller distance from one of the two ends of the contact carrier than from the other end thereof. In this case, however, the value of a position coordinate taken parallel to the connecting path, between the two contact carrier ends, at the location of the contact point should expediently be between 0.08 and 0.48 times the length of the connecting path, since otherwise the positional stability is reduced to an excessively great extent. In order to obtain a large isolating path and thus a high dielectric strength, in the case of a symmetrical antinode lying above the connecting path, the contact point should be arranged on or below the connecting path.

If the isolating point of the switch is bounded merely by the stationary and the moveable contact piece, then the contact carrier should be designed to be electrically conductive at least between one of its two ends and the moveable contact piece. An additional current feed to the moveable contact piece can then be obviated. By contrast, if the moveable contact piece is designed as a bridge contact, and if a further stationary contact piece is arranged on the substrate, which contact piece, like the other stationary contact piece, makes contact with the bridge contact in the switch-on position, then the contact carrier should be electrically insulated from the substrate or the bridge contact should be electrically insulated from the contact carrier.

In an embodiment of the microswitch according to the invention which is designed with particular operational reliability, the switch drive has two mutually independently displaceable mechanical actuation elements, of which one acts on the contact carrier in the event of switch-on with a force which is necessary in order to achieve the switch-on state through elastic deformation of the contact carrier and the other acts on the contact carrier in the event of switch-off with a force which is necessary in order to achieve the switch-off state through elastic deformation of the contact carrier. In the displacement direction, at least one of the two actuation elements should form an acute angle with the tangential plane at the bearing point of this actuation element on the contact carrier. This is because the deformation work in the event of switch-on or switch-off can then be done with a comparatively small drive force. A particularly suitable drive for this purpose with a large swing in conjunction with a comparatively low force is a drive having two electrostatically acting comb structures, a respective one of which interacts with a respective one of the two actuation elements. Such a drive can be worked out from the substrate together with the contact carrier in an economically advantageous manner, preferably by means of an ion etching method.

BRIEF DESCRIPTION OF THE DRAWINGS

The invention is explained below using exemplary embodiments.

WAYS OF EMBODYING THE INVENTION

Figure 1:
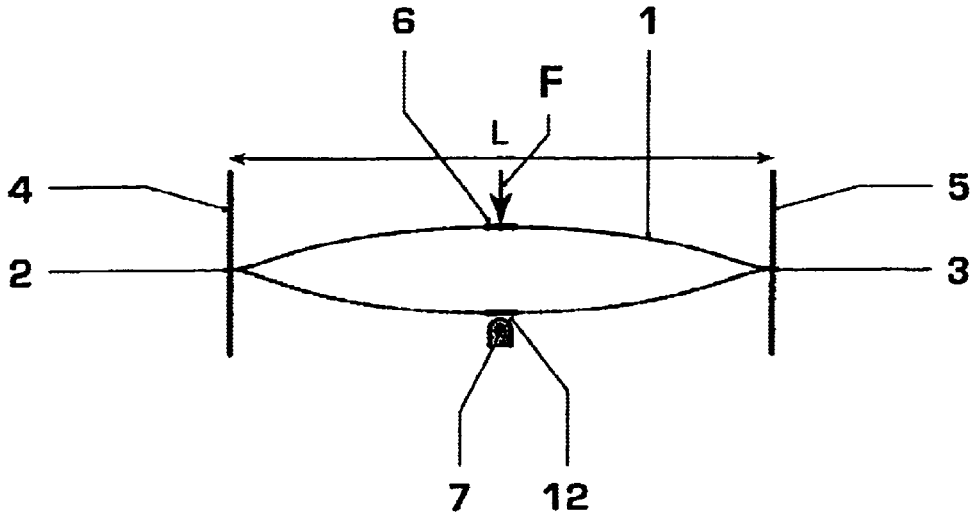
FIG. 1 shows a contact arrangement of a microswitch in a greatly simplified illustration.
Figure 2:
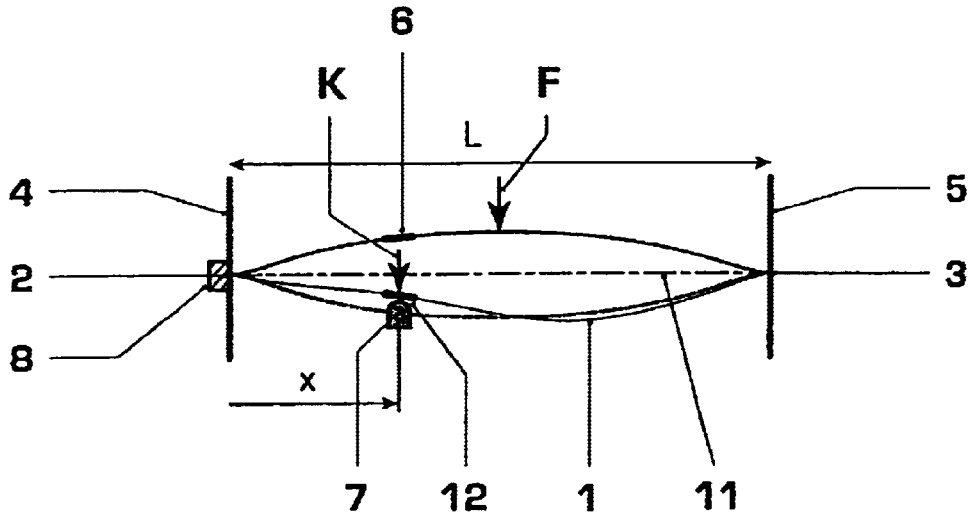
FIG. 2 shows a contact arrangement of a first embodiment of a microswitch according to the invention in a greatly simplified illustration.
Figure 3:
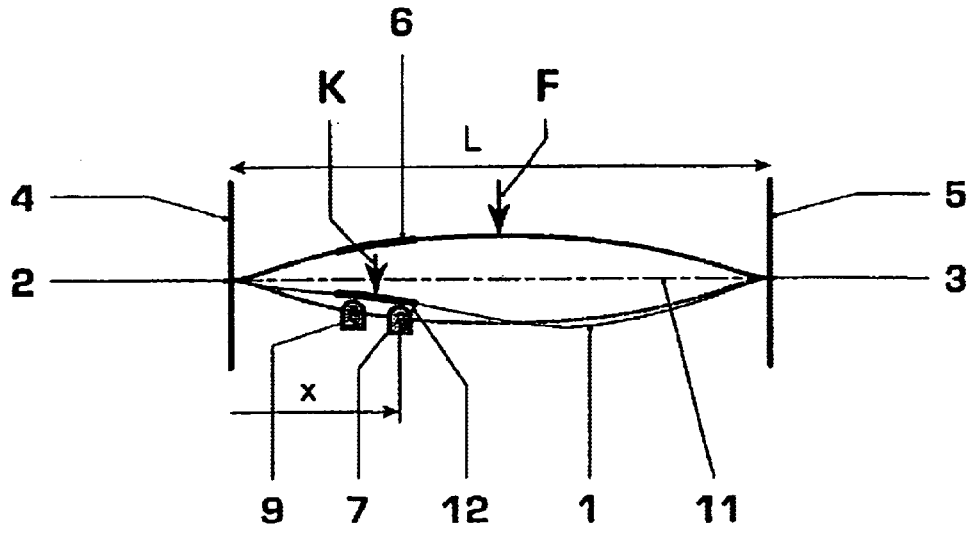
FIG. 3 shows a contact arrangement of a second embodiment of a microswitch according to the invention in a greatly simplified illustration.

In all the figures, identical reference symbols also designate identically acting parts. The contact arrangements of microswitches which are illustrated in FIGS. 1 to 3 are in each case worked micromechanically, i.e. by means of application and etching methods, from a plate-type substrate extended in the paper plane. The substrate is constructed in layered fashion and has buried layers which have been able to be removed at suitable points in order to make specific parts of the substrate moveable. Analogously to microelectronic methods, silicon is particularly suitable as structure material since it can be made either electrically insulating or electrically conductive given a suitable doping, depending on the requirement. The buried layers are formed by $SiO_2$. When using silicon on $SiO_2$ or a different insulator, it is possible in this case to have recourse to known SOI (silicon on insulator) structures, in particular, if monocrystalline silicon is preferred as structural material, on a SIMOX wafer.

In all the contact arrangements, a bendable contact carrier 1 designed as a bar or leaf has been etched into the substrate, which contact carrier is fixed to two substrate stages 4, 5 by its two ends 2, 3. The contact carrier 1 acts like a spiral spring and has a stable position which is produced during etching and at which it is formed in the manner of a symmetrical antinode (directed upward in the figures). A moveable contact piece 6 is fitted on the contact carrier 1 and makes electrical contact with a stationary contact piece 7 of the contact arrangement in the switch-on position of the switch and is isolated from the stationary contact piece 7 in the switch-off position of the switch. In the case of the contact arrangements according to FIGS. 1 and 2, that section of the contact carrier 1 which is situated between the end 2 and the moveable contact piece 6 is designed to be electrically conductive and a current terminal 8, which is electrically conductively connected to the end 2, is incorporated into the stage 4. The second current terminal of the contact arrangement is directly connected to the stationary contact piece 7. In the case of the contact arrangement according to FIG. 3, the moveable contact piece 6 is designed as a bridge contact which is arranged in the contact carrier 1 in an electrically insulated manner, or the entire contact carrier 1 is electrically insulated from the substrate. A further stationary contact piece 9 is arranged on the substrate. The two current terminals of the contact arrangement are in each case electrically conductively connected to one of the two stationary contact pieces 7, 9.

Figure 4:
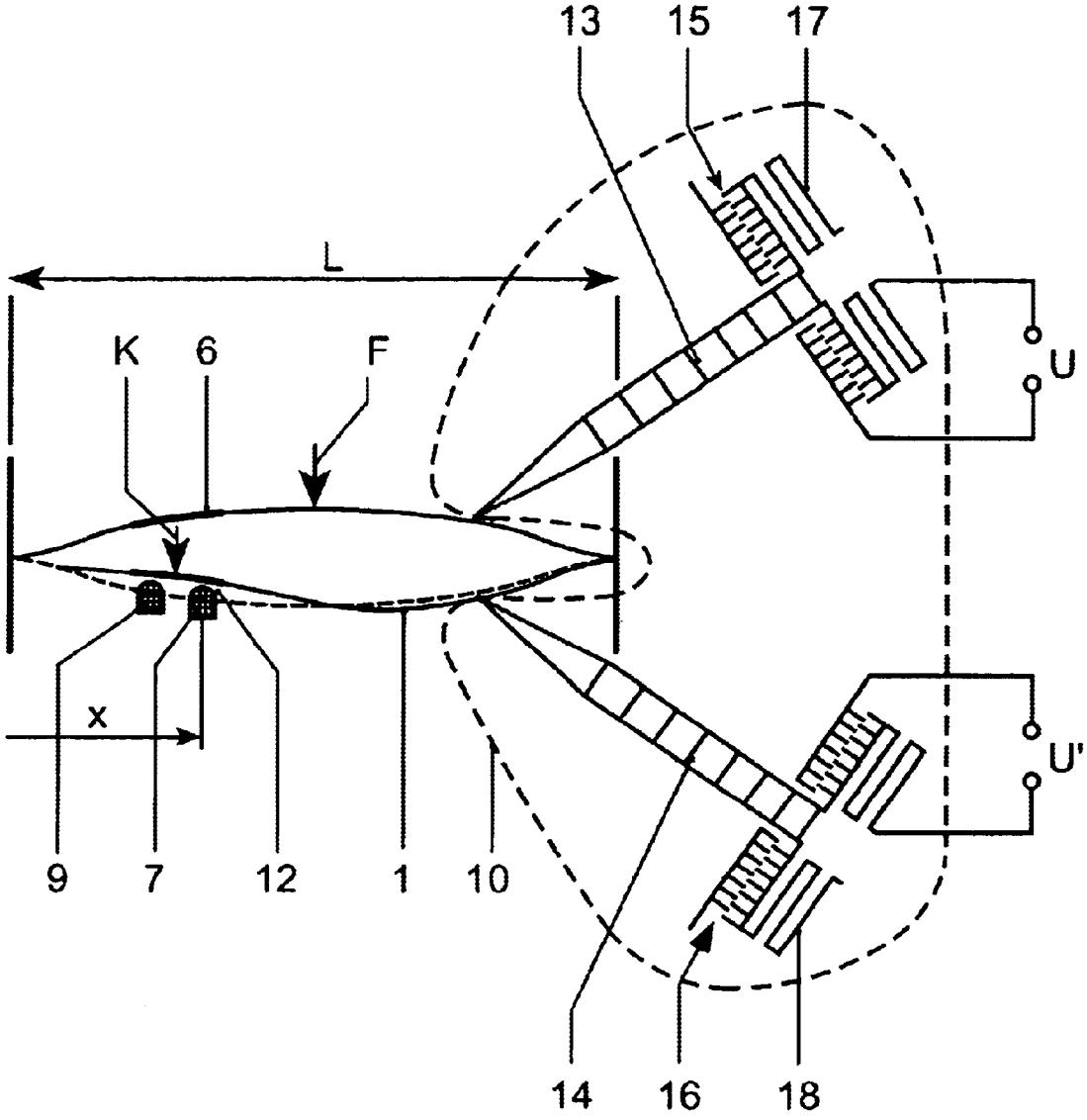
FIG. 4 shows the second embodiment of the microswitch according to the invention, in which, in addition to the contact arrangement in accordance with FIG. 3, a drive for the contact arrangement is now also illustrated in a greatly simplified manner.

By means of a drive 10, which can be seen from FIG. 4, in all three contact arrangements, the contact carrier 1 can be deformed flexurally elastically in substrate-parallel fashion, i.e. parallel to the paper plane. In all three contact arrangements, the contact pieces 6 and 7 or 6, 7 and 9 are isolated from one another in the upwardly pointing stable position of the contact carrier. The assigned microswitch is thus situated in its switch-off position. For switch-on, the contact carrier 1 is acted on by a deformation force F, by means of the drive 10, and guided downward under flexurally elastic deformation until the contacts 6 and 7 or 6 and 7 and also 6 and 9 make contact with one another.

In the case of the contact arrangement according to FIG. 1, the drive not only has to apply the deformation work, but then, in the switch-on position illustrated in a dotted manner in FIG. 1, during the entire switch-on duration, continuously also has to apply the bending force brought about by the flexurally elastic deformation of the contact carrier 1 and, in addition, also a contact force which presses the contact pieces together.

By contrast, in the case of the embodiments of the contact arrangement according to FIGS. 2 and 3, a stable switch-on position (shown in solid illustration) is achieved at which the contact carrier 1 is deformed in the manner of an asymmetrical antinode (a nonstable symmetrical switch-on position corresponding to the contact arrangement according to FIG. 1 is illustrated in a dotted manner). As a result of the deformation formed in the manner of an asymmetrical antinode, not only is a stable position achieved, but also, on account of snap action, at the same time, contact force K, which has to be cancelled again by the drive 10 during switch-off. The snap action is achieved by virtue of the fact that the stationary contact piece 7, at the contact point with the moveable contact piece 6, has a smaller distance from end 2 of the contact carrier 1 than from the end 3 thereof. In order still to achieve sufficiently high contact force through snap action, the value x of a position coordinate taken parallel to the connecting path 11 of length L between the two contact carrier ends 2, 3, at the location of the contact point 12 of the two contacts 6 and 7, should be between 0.08 and 0.48 times the length L of the connecting path. As can be seen from FIGS. 2 and 3, the contact point 12 lies below the connecting path 11 in the switch-on position. A dielectric strength high enough for relatively high voltages is thus achieved for the contact isolating path present with the contacts opened.

As can be gathered from FIG. 4, the drive 10 has two mutually independently displaceable mechanical actuation elements 13, 14, of which the actuation element 13 acts on the contact carrier 1 in the event of switch-on with a force F which is necessary in order to achieve the switch-on state through elastic deformation of the contact carrier 1. The second actuation element 14 acts on the contact carrier 1 in the event of switch-off with a counter force which is necessary in order to cancel the contact force K and achieve the switch-off state through elastic deformation of the contact carrier 1. The displacement direction of the two actuation elements forms an acute angle (α, α' in accordance with FIG. 4) with the tangential plane at the bearing point of this actuation element on the contact carrier. The actuation element can then apply a large deformation force with a relatively low force. During switch-off, a snap-over point is already reached after a smaller distance and with a smaller counter force than in the case of switch-on. The microswitch can therefore be opened significantly faster than it can be closed.

The drive has two electrostatically acting comb structures 15, 16, to which DC voltage U, U' can be applied, and also two restoring springs 17, 18. A respective one of the two comb structures and a respective one of the two restoring springs interacts with a respective one of the two actuation elements. For switch-on, the voltage U is applied to the comb structure 15. A comb of the comb structure 15 which is connected to the actuation element 13 and is mounted moveably on the restoring spring 17 is drawn into a stationary comb of the comb structure and tensions the restoring spring 17 in the process. In this case, the actuation element 13 bends the contact carrier 1 and guides it to the snap-over point, from where it springs the moveable contact piece 7 into the switch-on position with formation of the contact force K. The voltage U can then be removed. The actuation element 13 is returned again to its starting position by the restoring spring 17 and is ready for a further switch-on operation. In a corresponding manner, in the event of switch-off, a comb of the comb structure 16 which is connected to the actuation element 14 and is mounted moveably on the restoring spring 18 is drawn into a stationary comb of the comb structure 16 and the restoring spring 18 is tensioned in the process. In this case, the actuation element 14 bends the contact carrier 1 and guides it to the snap-over point, from where it springs back into the original position.

LIST OF DESIGNATIONS

| | |
|---|---|
| 1 | Contact carrier |
| 2, 3 | Ends of the contact carrier |
| 4, 5 | Substrate stages |
| 6 | Moveable contact piece |
| 7, 9 | Stationary contact pieces |
| 8 | Current terminal |
| 9 | Ring |
| 10 | Drive |
| 11 | Connecting path |
| 12 | Contact point |
| 13, 14 | Actuation elements |
| 15, 16 | Electrostatic comb structures |
| 17, 18 | Restoring springs |
| α, α' | Acute angles |
| U, U' | DC voltages |
| L | Path length |
| x | Distance |

I claim:

1. A microswitch having a predominantly plate-shaped substrate, a stationary contact piece fitted on the substrate, a moveable contact piece, which electrically contacts the stationary contact piece in the switch-on position of the switch and is isolated from the stationary contact piece in the switch-off position of the switch, a bendable contact carrier, which holds the moveable contact piece and is fixed to the substrate by two ends, and a drive which guides the contact carrier into the switch-on or switch-off position by elastic deformation, wherein the contact carrier is deformable in a substrate-parallel fashion, and wherein, in a first stable position corresponding to the switch-off position, the contact carrier has the form of a symmetrical antinode, and wherein, in a second stable position corresponding to the switch-on position, the contact carrier is formed in the manner of an asymmetrical antinode.

2. The microswitch as claimed in claim 1, wherein the stationary contact piece has, at a contact point with the moveable contact piece, a smaller distance from a first of the two ends of the contact carrier than from the second end thereof.

3. The microswitch as claimed in claim 2, wherein the value of a position coordinate taken parallel to the connecting path between the two contact carrier ends is between 0.08 and 0.48 times the length of the connecting path at the location of the contact point.

4. The microswitch as claimed in claim 3, wherein, in the case of a symmetrical antinode lying above the connecting path the contact point is arranged on or below the connecting path.

5. The microswitch as claimed in claim 1, wherein the the contact carrier is designed to be electrically conductive at least between one of its two ends and the moveable contact piece.

6. The microswitch as claimed in claim 1, wherein the moveable contact piece is designed as a bridge contact, and wherein a further stationary contact piece is arranged on the substrate, which contact piece makes contact with the bridge contact in the switch-on position.

7. The microswitch as claimed in claim 1, wherein the drive has two mutually independently displaceable mechanical actuation elements, of which a first acts on the contact carrier in the event of switch-on with a force which is necessary for achieving the switch-on state through elastic deformation of the contact carrier, and a second acts on the contact carrier in the event of switch-off with a force which is necessary for achieving the switch-off state through elastic deformation of the contact carrier.

8. The microswitch as claimed in claim 7, wherein the displacement direction of at least one of the two actuation elements forms an acute angle with the tangential plane at the bearing point of said actuation element on the contact carrier.

9. The microswitch as claimed in claim 7, wherein the drive has two electrostatically acting spring-loaded comb structures, a respective one of which interacts with a respective one of the two actuation elements.

10. The inicroswitch as claimed in claim 9, wherein at least the contact carrier and/or the drive are worked out from the substrate preferably by means of an ion etching method.

* * * * *